US012109467B1

(12) United States Patent
Xie

(10) Patent No.: US 12,109,467 B1
(45) Date of Patent: Oct. 8, 2024

(54) GRIP LOCK BOTTOM FOR GOLF BAG AND GOLF BAG INCLUDING THE SAME

(71) Applicant: Meiling Xie, Xiamen (CN)

(72) Inventor: Meiling Xie, Xiamen (CN)

( * ) Notice: Subject to any disclaimer, the term of this patent is extended or adjusted under 35 U.S.C. 154(b) by 0 days.

(21) Appl. No.: 18/401,656

(22) Filed: Jan. 1, 2024

(30) Foreign Application Priority Data

Jun. 13, 2023 (CN) ..... 202321502123.6

(51) Int. Cl.
*A63B 55/40* (2015.01)

(52) U.S. Cl.
CPC ..... *A63B 55/40* (2015.10)

(58) Field of Classification Search
CPC ..... A63B 55/40
USPC ..... 206/315.3, 315.4–315.8
See application file for complete search history.

(56) References Cited

U.S. PATENT DOCUMENTS 6,148,998 A * 11/2000 Tan ..... A63B 55/00 206/315.3
9,700,773 B2 * 7/2017 Wang ..... A45C 7/009
2002/0115495 A1 * 8/2002 Tan ..... A63B 55/00 206/315.6
2004/0200746 A1 * 10/2004 Kang ..... A63B 55/00 206/315.3
2014/0034527 A1 * 2/2014 Anderson ..... A63B 55/40 206/315.6

* cited by examiner

*Primary Examiner* — Don M Anderson
*Assistant Examiner* — Jessica Kavini Tamil

(57) ABSTRACT

A grip lock bottom for a golf bag and a golf bag are provided, wherein the grip lock bottom includes: a lower housing; an inner lining element, the inner lining element being arranged in the lower housing, the inner lining element being provided with a plurality of separating members, the separating members dividing a plurality of separating grooves in the inner lining element, the inner lining element being provided with a plurality of resilient pressing members for pressing against a golf club grip on both sides of the separating grooves; and a connecting member, the connecting member being mounted on the lower housing and pressing and fixing the inner lining element in the lower housing, a top of the connecting member being connected to a bag body of the golf bag. By means of that an inner lining element is provided and a resilient pressing member on the inner lining element presses and fixes the golf clubs in the separating groove, thereby it prevents the golf clubs from randomly shaking, and thus prevents damage by collision between the golf clubs as well as making strange noises.

14 Claims, 3 Drawing Sheets

GRIP LOCK BOTTOM FOR GOLF BAG AND GOLF BAG INCLUDING THE SAME

TECHNICAL FIELD OF THE INVENTION

The present disclosure relates to the technical field of golf bags, and in particular to a grip lock bottom for a golf bag, and a golf bag including the same.

BACKGROUND OF THE INVENTION

As is well known, golf is a sport in which the rule is to use different golf clubs to hit a golf ball into a hole, so that each athlete needs to be equipped with a plurality of different golf clubs, such as driver, fairway woods, irons, wedges, putters and so on.

Therefore, each athlete needs to be equipped with a golf bag for storing golf clubs, and the existing golf bag usually is made up of a molded top, a bag body with a strap, and a bottom, the top and the bottom are mounted on the top and the bottom of the bag body, respectively, and when in use, golf clubs are inserted into the bag body through the top, and are arranged on the bottom, and the athlete carries the bag on his/her shoulder through the strap.

However, through observation, it is found that the existing golf bag bottom is not provided with a structure that plays a role in limiting the position of the golf clubs, so that the golf clubs were inserted into the golf bag will smack into each other randomly and have the clanging noise.

In view of this, the applicant has developed and designed this disclosure in response to the many shortcomings and inconveniences caused by the incomplete design of the golf bag bottom structure mentioned above, and actively studied and improved it.

SUMMARY OF THE INVENTION

It is an object of the present disclosure to provide a grip lock bottom for a golf bag for preventing damage from collision between golf clubs as well as noise.

In order to achieve the above object, a solution of the present disclosure is provided:

A grip lock bottom for a golf bag, the grip lock bottom comprising:

a lower housing;

an inner lining element, the inner lining element being arranged in the lower housing, the inner lining element being provided with a plurality of separating members, the separating members dividing a plurality of separating grooves in the inner lining element, the inner lining element being provided with a plurality of resilient pressing members on both sides of the separating grooves for pressing against a golf club grip;

and a connecting member, the connecting member being mounted on the lower housing and pressing and fixing the inner lining element in the lower housing, the top of the connecting member being connected to the bag body of the golf bag.

Preferably, the inner lining element, the separating member and resilient pressing member are integrally formed.

Preferably, the inner lining element is provided with a reinforcing bar at the bottom of the separating groove, the reinforcing bar being connected to the inner wall of the inner lining element along the longitudinal direction of the separating groove.

Preferably, the reinforcing bars are provided on both sides with connecting bars connected to the end of the resilient pressing member.

Preferably, the reinforcing bars and the connecting bars are provided with support bars at the bottom, the support bars being supported on the lower housing after the inner lining element is mounted in the lower housing.

Preferably, a plug fit sleeve is provided in the lower housing, the bottom of the reinforcing bar is provided with a plug fit column, the plug fit column being inserted in the plug fit sleeve.

Preferably, the outer wall of the inner lining element is provided with an inwardly recessed arcuate groove, the inner wall of the connecting member is provided with a pressing column, the pressing column fits in the arcuate groove and presses and fixes the inner lining element in the lower housing.

Preferably, a corner plate is provided on the outer edge of the bottom of the inner lining element, the connecting member sleeves on the inner lining element and the bottom of the connecting member presses against the corner plate.

Preferably, the corner plate is provided with a positioning groove, a positioning block is provided in the lower housing, the positioning block fits in the positioning groove.

Preferably, the grip lock bottom further comprises a separating plate, the separating plate is detachably mounted on an upper end of a separating member, the upper end of the separating plate is connected with a dividing cloth in a golf bag.

Preferably, the grip lock bottom of the separating plate is provided with a snap-in foot and a snap-in portion, the separating member is provided with a first snap fit hole and a snap fit slot, the snap-in foot is movably coupled with the first snap fit hole, and the snap-in portion is inserted in the snap fit slot.

Preferably, a support column is provided on the bottom of the separating member, the support column is supported on the lower housing after the inner lining element is mounted in the lower housing.

Preferably, the connecting member is provided with a second snap fit hole, the inner wall of the lower housing is provided with a snap-in nose, and the connecting member is detachably mounted on the snap-in nose of the lower housing by the second snap fit hole.

Preferably, the lower housing is further provided with a plurality of drainage holes.

The present disclosure also discloses a golf bag, the golf bag is provided with the grip lock bottom.

With the adoption of the above-described solution, by means of that an inner lining element is provided and a resilient pressing member on the inner lining element presses and fixes the golf clubs in the separating groove, thereby the present disclosure prevents the golf clubs from randomly shaking, and thus prevents damage by collision between the golf clubs as well as making strange noises.

Moreover, when the grip lock bottom of the present disclosure is assembled, only the inner lining element needs to be arranged in the lower housing, and then the connecting member is mounted on the lower housing to complete the assembly of the grip lock bottom, which has the advantages of easy assembly and high efficiency.

Moreover, by dividing the grip lock bottom into three parts, namely, the lower housing, the inner lining element, and the connecting member, which can be produced separately and independently, the present disclosure has the advantage of convenient production; and when installing, the connecting member can be mounted on the bag body of the golf bag first, and the connecting member has a simple structure, which enables it to be mounted on the bag body of the golf bag in a quick and convenient manner, and the lower housing, the inner lining element, and the connecting member mounted on the bag body of the golf bag can be assembled together afterward, and in this way, the golf bag has the advantage of high production efficiency.

DESCRIPTION OF REFERENCE SIGNS

In the figures: 1, lower housing; 11, plug fit sleeve; 12, positioning block; 13, snap-in nose; 14, drainage hole; 2, inner lining element; 21, separating member; 211, first snap fit hole; 212, snap fit slot; 213, support column; 22, separating groove; 23, resilient pressing member; 24, reinforcing bar; 241, plug fit column; 25, connecting bar; 26, support bar; 27, arcuate groove; 28, corner plate; 281, positioning groove; 3, connecting member; 31, pressing column; 32, second snap fit hole; 4, separating plate; 41, snap-in foot; 42, snap-in portion.

DETAILED DESCRIPTION OF THE PREFERRED EMBODIMENT

In order to further explain the technical solutions of the present disclosure, the present disclosure is described in detail below by way of specific embodiments.

In the description of the present disclosure, it is to be understood that the terms "center", "vertical", "horizontal", "up", "down", "front", "back", "left", "right", "vertical", "horizontal", "top", "bottom", "inside", "outside", etc. indicate orientations or positional relationships based on those shown in the accompanying drawings, and are intended only to facilitate the description of the present disclosure and to simplify the description, and are not intended to indicate or imply that the device or element referred to must have a particular orientation, be constructed and operated in a particular orientation, and therefore are not to be construed as a limitation of the present disclosure. In the description of the present disclosure, unless otherwise indicated, "a plurality of" means two or more.

Figure 1:
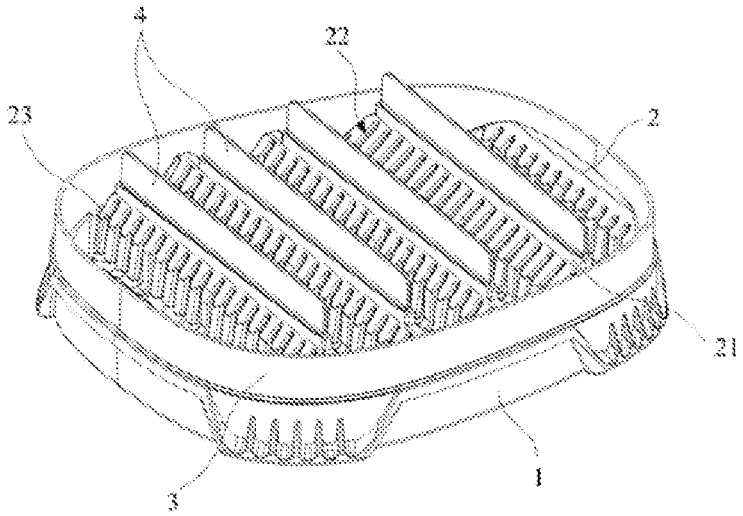
FIG. 1 shows a schematic diagram of the structure of a preferred embodiment of the present disclosure.
Figure 2:
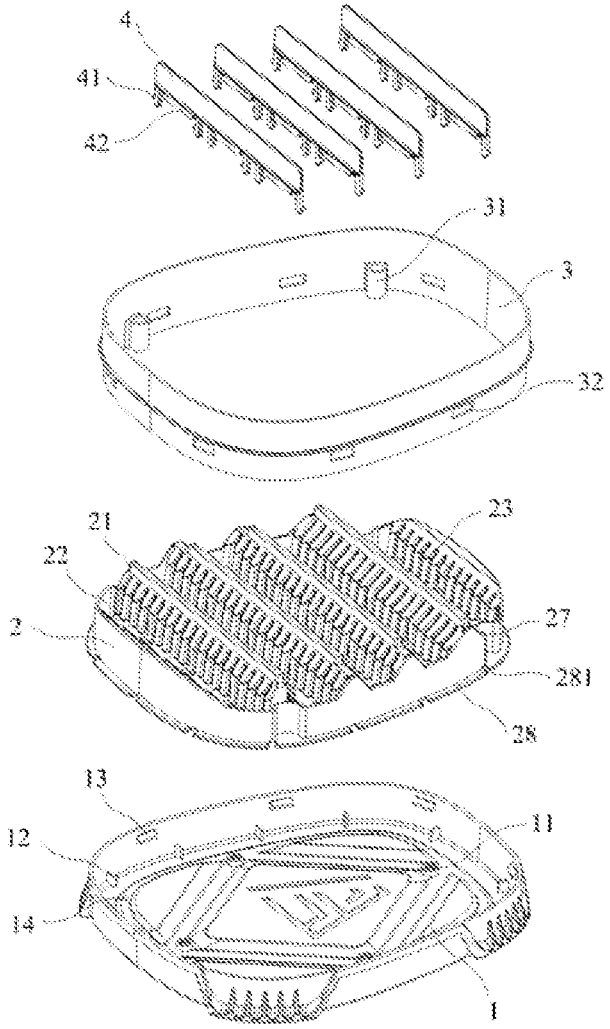
FIG. 2 shows an exploded view of a preferred embodiment of the present disclosure.
Figure 3:
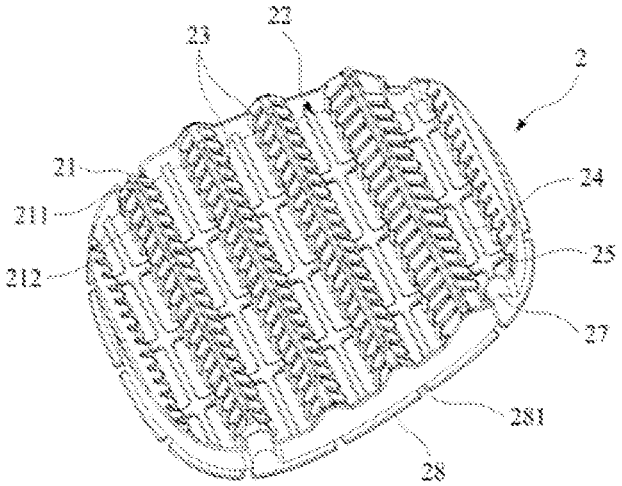
FIG. 3 shows a schematic view of the structure of an inner lining element in a preferred embodiment of the present disclosure.
Figure 4:
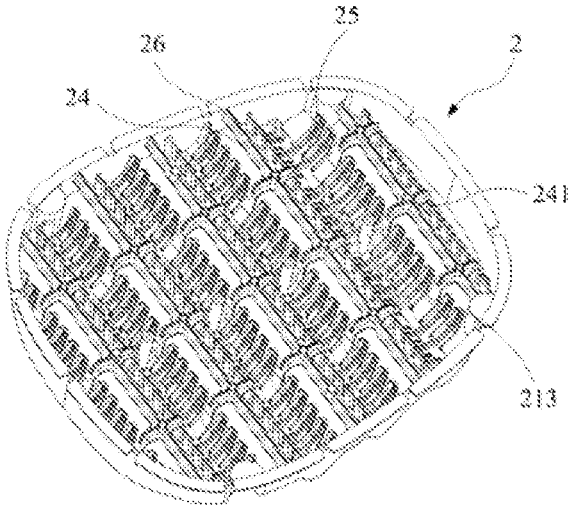
FIG. 4 shows another schematic diagram of the structure of the inner lining element in a preferred embodiment of the present disclosure.

As shown in FIGS. 1 to 4, a preferred embodiment of a grip lock bottom for a golf bag of the present disclosure, the grip lock bottom comprises: a lower housing 1; an inner lining element 2, the inner lining element 2 being arranged in the lower housing 1, the inner lining element 2 being provided with a plurality of separating members 21, the separating members 21 dividing a plurality of separating grooves 22 in the inner lining element 2, the inner lining element 2 being provided on both sides of the separating grooves 22 with a plurality of resilient pressing members 23 for pressing tightly a golf club grip; and a connecting member 3, the connecting member 3 being mounted on the lower housing 1 and press-fastening the inner lining element 2 in the lower housing 1, the top of the connecting member 3 being connected to the bag body of the golf bag.

When installing, the inner lining element 2 is arranged in the lower housing 1 and the connecting member 3 is mounted on the lower housing 1, and the inner lining element 2 is press-fastened in the lower housing 1 by the connecting member 3, and the top of the connecting member 3 is connected to the bag body of the golf bag, and the grip lock bottom of the present disclosure can be installed on the golf bag.

When in use, a golf club is inserted into the golf bag through the top, the club grip is inserted downwardly into the separating groove 22, and the resilient pressing members 23 on both sides of the separating groove 22 press-fasten and fix the club grip in the separating groove 22, so as to prevent the golf club from randomly swaying.

The focus of the present disclosure is that the present disclosure prevents the golf clubs from shaking randomly by providing the inner lining element 2 and utilizing the resilient pressing members 23 on the inner lining element 2 to press and fix the golf clubs in the separating groove 22, thereby preventing collision damages between the golf clubs as well as abnormal noise.

Moreover, when the grip lock bottom of the present disclosure is assembled, only the inner lining element 2 is arranged in the lower housing 1, and then the connecting member 3 is mounted on the lower housing 1 to complete the assembly of the grip lock bottom, which has the advantages of easy assembly and high efficiency.

Moreover, by dividing the grip lock bottom into three parts, namely, the lower housing 1, the inner lining element 2, and the connecting member 3, they can be produced separately and independently in the present disclosure, which has the advantage of convenient production; and when installing, the connecting member 3 can be installed on the bag body of the golf bag first, and the connecting member 3 has a simple structure, which can be installed on the bag body of the golf bag in a quick and convenient manner, and then the lower housing 1, the inner lining element 2, and the connecting member 3 installed on the bag body of the golf bag can be assembled together, which has the advantage of convenient assembly and high efficiency.

The inner lining element 2, the separating member 21 and the resilient pressing member 23 described above are integrally formed. In this way, the inner lining element 2, the separating member 21 and the resilient pressing member 23 are formed in a one-piece, which has the advantages of easy production and solid and reliable structure.

The above described inner lining element 2 is provided with a reinforcing bar 24 on the bottom of the separating groove 22, and the reinforcing bar 24 is connected to the inner wall of the inner lining element 2 in the longitudinal direction of the separating groove 22. In this way, golf clubs inserted into the golf bag are accommodated on the reinforcing bar 24 for placing the golf clubs, and the reinforcing bar 24 further provides the inner lining element 2 with the advantage of a strong and reliable structure.

Connecting bars 25, which are connected to the ends of the resilient pressing member 23, are provided on both sides of the reinforcing bar 24, so that the reinforcing bar 24 can be connected to the separating member 21 by the connecting bars 25 and the resilient pressing member 23, which further provides an advantage of the structural robustness and reliability of the inner lining element 2.

The bottom of the above-mentioned reinforcing bars 24 and connecting bars 25 are provided with support bars 26, which are supported on the lower housing 1 after the inner lining element 2 is installed in the lower housing 1. In this way, the support bars 26 provide support to the inner lining element 2, making the installation of the inner lining element 2 more stable.

A plug fit sleeve 11 is provided in the above-mentioned lower housing 1, and the bottom of the reinforcing bar 24 is provided with a plug fit column 241, which plugs in the plug fit sleeve 11. In this way, the inner lining element 2 can be inserted in the plug fit sleeve 11 and arranged in the lower housing 1 by the plug fit column 241, which makes the connection between the inner lining element 2 and the lower housing 1 more solid and stable.

The outer wall of the above-described inner lining element 2 is provided with an inwardly recessed arcuate groove 27, and the inner wall of the connecting member 3 is provided with a pressing column 31, which fits in the arcuate groove 27 and presses and fixes the inner lining element 2 in the lower housing 1. In this way, the connecting member 3 can firmly press and fix the inner lining element 2 in the lower housing 1, and after the connecting member 3 is mounted on the lower housing 1, the pressing column 31 on the connecting member 3 and the arcuate groove 27 can cooperate with each other and limit the position of the inner lining element 2, so as to prevent the inner lining element 2 from shifting.

A corner plate 28 is provided on the outer edge of the bottom of the inner lining element 2, and the connecting member 3 is sleeved and attached to the inner lining element 2 and the bottom of the connecting member 3 is pressed against the corner plate 28. In this way, the connecting member 3 securely presses and fixes the inner lining element 2 in the lower housing 1.

The corner plate 28 is provided with a positioning groove 281, and the lower housing 1 is provided with a positioning block 12, which fits in the positioning groove 281. In this way, when the inner lining element 2 is arranged in the lower housing 1, the installation position of the inner lining element 2 in the lower housing 1 can be quickly determined by the cooperation of the positioning groove 281 and the positioning block 12, so as to facilitate the assembly of the grip lock bottom; moreover, the lower housing 1 can also play a role in limiting the position of the inner lining element 2 by the cooperation of the positioning block 12 and the positioning groove 281, so as to avoid the inner lining element 2 from shifting.

The above grip lock bottom further comprises a separating plate 4, which is detachably mounted on the upper end of the separating member 21, and the upper end of the separating plate 4 is connected to the dividing cloth inside the golf bag. In this way, the golf bag is able to be separated into a plurality of independent spaces by the dividing cloth and the separating plate 4, further avoiding mutual contact wear between golf clubs.

The bottom of the above-described separating plate 4 is provided with a snap-in foot 41 and a snap-in portion 42, the separating member 21 is provided with a first snap fit hole 211 and a snap fit slot 212, the snap-in foot 41 is movably snapped and connected with the first snap fit hole 211, and the snap-in portion 42 is inserted in the snap fit slot 212. In this manner, the snap-in foot 41 is inserted into the first snap fit hole 211, the snap-in portion 42 is inserted into the snap fit slot 212, so that the snap-in foot 41 is snapped and engaged with the first snap fit hole 211, and the separating plate 4 can be mounted on the separating member 21; therein, the snap-in portion 42 and the snap fit slot 212 can cooperate with each other to make the connection between the separating plate 4 and the separating member 21 more solid and stable.

A support column 213 is provided on the bottom of the above-described separating member 21, and the support column 213 is supported on the lower housing 1 after the inner lining element 2 is installed in the lower housing 1. In this way, the inner lining element 2 is supported by the support column 213, which makes the installation of the inner lining element 2 more stable.

The above-described connecting member 3 is provided with a second snap fit hole 32, the inner wall of the lower housing 1 is provided with snap-in nose 13, and the connecting member 3 is detachably mounted on the snap-in nose 13 of the lower housing 1 by the second snap fit hole 32. In this way, when installing, the second snap fit hole 32 on the connecting member 3 is aligned with the snap-in nose 13 on the lower housing 1, and then the connecting member 3 is slightly compressed inwardly and inserted into the lower housing 1 along the inner wall of the lower housing 1, and after that, the connecting member 3 is loosened to make the connecting member 3 return to its original state, and while returning to its original state, the second snap fit hole 32 is able to be snapped onto the snap-in nose 13, so that the connecting member 3 is snapped installed on the lower housing 1 by the snap connection of the second snap fit hole 32 and the snap-in nose 13.

A plurality of drainage holes 14 are also provided in the aforementioned lower housing 1. In this way, water entering the golf bag can be drained out by the drainage holes 14 to prevent water from accumulating inside the grip lock bottom.

The present disclosure also discloses a golf bag that is provided with the aforementioned grip lock bottom.

The foregoing descriptions of specific exemplary embodiments of the present disclosure are for purposes of illustration and exemplification, and these descriptions are not intended to limit the present disclosure to the specific form disclosed, and it is clear that many alterations and variations can be made in accordance with the above teachings. The exemplary embodiments are selected and described for the purpose of explaining the particular principles of the present disclosure and their practical applications, so as to enable a ordinary skilled person in the art to realize and make use of various different exemplary embodiments of the present disclosure, as well as various different selections and variations thereof, and any changes or modifications thereto appropriately made by a ordinary skilled person in the art are to be regarded as not being out of the protection scope of the present disclosure.

The invention claimed is:

1. A grip lock bottom for a golf bag, wherein the grip lock bottom comprises:

a lower housing;

an inner lining element, the inner lining element being arranged in the lower housing, the inner lining element being provided with a plurality of separating members, the separating members dividing a plurality of separating grooves in the inner lining element, the inner lining element being provided with a plurality of resilient pressing members for pressing against a golf club grip on both sides of the separating grooves; and a connecting member, the connecting member being mounted on the lower housing and pressing and fixing the inner lining element in the lower housing, a top of the connecting member being connected to a bag body of the golf bag, wherein the grip lock bottom further comprises a separating plate, the separating plate is detachably mounted on an upper end of the separating member, an upper end of the separating plate is connected with a dividing cloth in the golf bag.

2. The grip lock bottom for a golf bag according to claim 1, wherein the inner lining element, the separating member and the resilient pressing member are integrally formed.

3. The grip lock bottom for a golf bag according to claim 1, wherein the inner lining element is provided with a reinforcing bar on a bottom of the separating groove, the reinforcing bar is connected to an inner wall of the inner lining element along a longitudinal direction of the separating groove.

4. The grip lock bottom for a golf bag according to claim 3, wherein the reinforcing bars are provided on both sides with connecting bars connected to an end of the resilient pressing member.

5. The grip lock bottom for a golf bag according to claim 4, wherein the reinforcing bars and the connecting bars are provided with support bars on the bottom, the support bars are supported on the lower housing after the inner lining element is mounted in the lower housing.

6. The grip lock bottom for a golf bag according to claim 3, wherein a plug fit sleeve is provided in the lower housing, a bottom of the reinforcing bar is provided with a plug fit column, the plug fit column is inserted in the plug fit sleeve.

7. The grip lock bottom for a golf bag according to claim 1, wherein an outer wall of the inner lining element is provided with an inwardly recessed arcuate groove, an inner wall of the connecting member is provided with a pressing column, the pressing column fits in the arcuate groove and presses and fixes the inner lining element in the lower housing.

8. The grip lock bottom for a golf bag according to claim 1, wherein a corner plate is provided on an outer edge of a bottom of the inner lining element, the connecting member sleeves on the inner lining element and a bottom of the connecting member presses against the corner plate.

9. The grip lock bottom for a golf bag according to claim 8, wherein the corner plate is provided with a positioning groove, a positioning block is provided in the lower housing, the positioning block fits in the positioning groove.

10. The grip lock bottom for a golf bag according to claim 1, wherein a bottom of the separating plate is provided with a snap-in foot and a snap-in portion, the separating member is provided with a first snap fit hole and a snap fit slot, the snap-in foot is movably coupled with the first snap fit hole, and the snap-in portion is inserted in the snap fit slot.

11. The grip lock bottom for a golf bag according to claim 1, wherein a support column is provided on a bottom of the separating member, the support column is supported on the lower housing after the inner lining element is mounted in the lower housing.

12. The grip lock bottom for a golf bag according to claim 1, wherein the connecting member is provided with a second snap fit hole, an inner wall of the lower housing is provided with a snap-in nose, and the connecting member is detachably mounted on the snap-in nose of the lower housing by the second snap fit hole.

13. The grip lock bottom for a golf bag according to claim 1, wherein a plurality of drainage holes are further provided in the lower housing.

14. A golf bag, wherein the golf bag is provided with the grip lock bottom for a golf bag according to claim 1.

* * * * *